United States Patent [19]

McGuigan

[11] Patent Number: 4,698,979

[45] Date of Patent: Oct. 13, 1987

[54] UNITARY EVAPORATIVE COOLER ASSEMBLY WITH MECHANICAL REFRIGERATION SUPPLEMENT

[76] Inventor: Brian G. McGuigan, P.O. Box 965, Eagar, Ariz. 85925

[21] Appl. No.: 10,765

[22] Filed: Feb. 4, 1987

[51] Int. Cl.[4] ..... F28D 3/00; F25B 7/00

[52] U.S. Cl. ..... 62/171; 62/175; 62/311; 62/332

[58] Field of Search ..... 62/171, 181, 183, 184, 62/188, 175, 305, 309, 310, 311, 314, 315, 316, 332, DIG. 17, 333; 165/60; 261/26, 27

[56] References Cited

U.S. PATENT DOCUMENTS

| | | | |
|---|---|---|---|
| 2,259,541 | 10/1941 | Ballard | 62/311 X |
| 3,153,332 | 10/1964 | Goettl et al. | 62/311 X |
| 4,178,764 | 12/1979 | Rowe | 62/175 X |
| 4,353,219 | 10/1982 | Patrick, Jr. | 62/183 |

*Primary Examiner*—Harry B. Tanner
*Attorney, Agent, or Firm*—Harvey B. Jacobson

[57] ABSTRACT

A substantially conventional evaporative cooler assembly is provided incorporating a water sump having an overflow and with which a float valve equipped pressurized supply of cool ground water is operatively associated for admitting water into the sump to an operating level slightly below the overflow level. A pump assembly is provided for pumping water from the sump to an evaporative pad through which air flowing through the cooler passes and a mechanical refrigeration unit including a compressor, evaporator coil and condenser coil is operatively associated with the cooler assembly. The evaporator coil is disposed across the flow of air moving through the cooler downstream from the evaporator pad, the condenser coil is mounted within the sump below operating level of water therein and further a cool ground water supply is provided for bypassing the float controlled water supply and admitting water into the sump responsive to the temperature of water within the sump increasing above a predetermined temperature.

7 Claims, 3 Drawing Figures

UNITARY EVAPORATIVE COOLER ASSEMBLY WITH MECHANICAL REFRIGERATION SUPPLEMENT

BACKGROUND OF THE INVENTION

1. Field of the Invention

This invention relates to an evaporative cooler incorporating a supplemental mechanical refrigeration assembly wherein the evaporator coil of the mechanical refrigeration assembly is disposed in the air being discharged from the cooler and the condenser coil of the mechanical refrigeration assembly is disposed in the water sump for the evaporative cooler. The water sump includes a float controlled water supply and an overflow drain, as is conventional, but the water supply additionally includes a bypass bypassing the water level controlling float of the float controlled water supply and operative to supply water to the sump in excess of that allowed by the float responsive to the temperature of the water within the sump rising above a predetermined maximum.

2. Description of Related Art

Various different forms of evaporative coolers including refrigeration supplements as well as other cooling devices incorporating some of the general structural and operational features of the instant invention heretofore have been known. Examples of these previously known structures are disclosed in U.S. Pat. Nos. 2,165,979, 2,259,541, 2,703,228, 2,902,834, 3,182,718, 3,859,818, 3,877,244 and 4,505,327. However, these previously known forms of cooling devices do not include the overall combination of structural features of the instant invention.

SUMMARY OF THE INVENTION

The unitary evaporative cooler assembly of the instant invention incorporates a mechanical refrigeration supplement with the condenser coil of the mechanical refrigeration supplement being disposed within the water sump of the evaporative cooler. Although water is supplied to the sump through a float controlled valve from a source of cool ground-temperature water under pressure and the sump includes an overflow for draining excess water therefrom, the assembly of the instant invention incorporates a solenoid controlled water supply bypass line for supplying water to the cooler assembly sump in excess of that allowed by the float controlled valve and in response to the temperature of the water within the sump rising above a predetermined minimum. Of course, water supplied to the sump either through the float controlled valve or the solenoid controlled bypass valve is received from a domestic water supply wherein the temperature of the suppled water is between 50 and 60 degrees Fahrenheit. Thus, when the water within the sump absorbs sufficient heat from the mechanical refrigeration condenser coil sufficient to raise the temperature of the water within the sump to a point at which the head pressure of the mechanical refrigeration supplement becomes excessively high, a temperature sensor controlled solenoid valve opens in the bypass line and additional water under pressure is supplied to the water sump in order to reduce the temperature of the water in the sump. Any added water in excess of the maximum desired level of water in the sump is drained therefrom through a water overflow drain outlet.

The main object of this invention is to provide an efficient mechanical refrigeration supplement for an evaporative cooler.

Another object of this invention is to provide a unitary evaporative cooler assembly with mechanical refrigeration supplement wherein substantially all of the air handling and cooling components of the evaporative cooler and mechanical refrigeration supplement are contained within a single housing of an evaporative cooler assembly.

Another object of this invention, in accordance with the immediately preceding object, is to provide a mechanical refrigeration supplement for an evaporative cooler assembly including a water sump and wherein the condenser coils of the mechanical refrigeration supplement are disposed within the water sump.

Still another object of this invention is to provde a unitary evaporative cooler assembly incorporating a mechanical refrigeration supplement and wherein the assembly will be able to provide the desired cooling and dehumidifying even during high temperature humid weather.

A final object of this invention to be specifically enumerated herein is to provide a combined evaporative cooler and mechanical refrigeration assembly in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
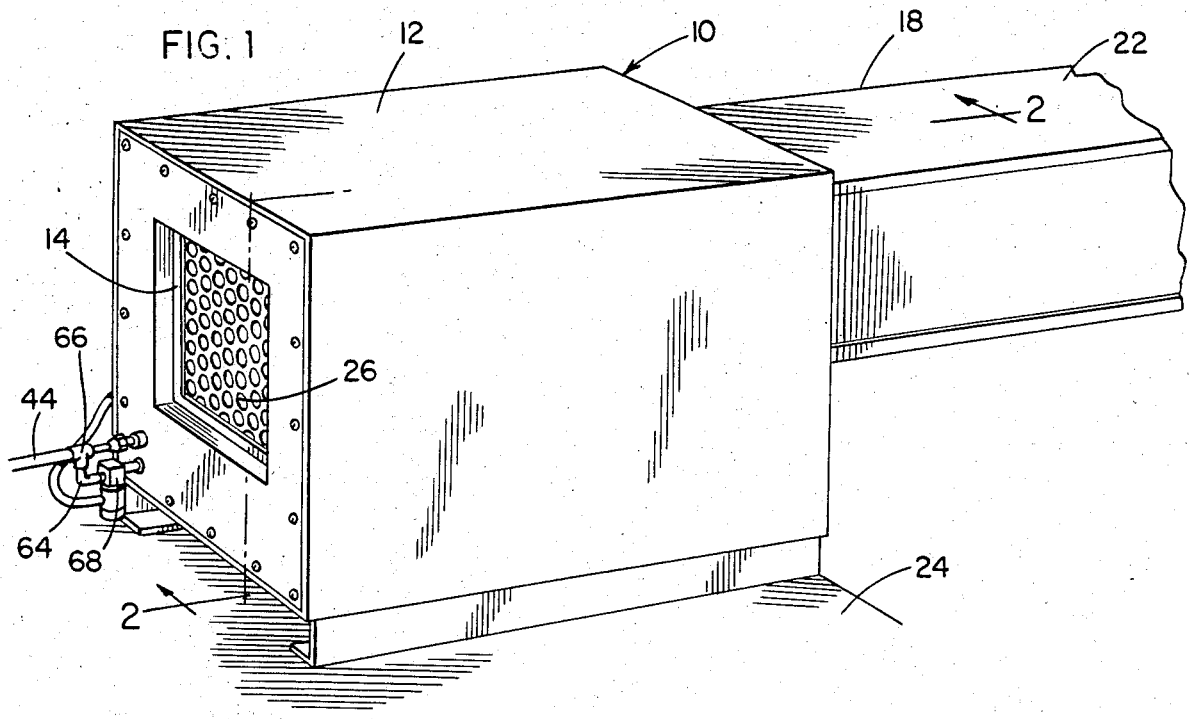
FIG. 1 is a perspective view of the evaporative cooler assembly of the instant invention which incorporates a mechanical refrigeration supplement.
Figure 3:
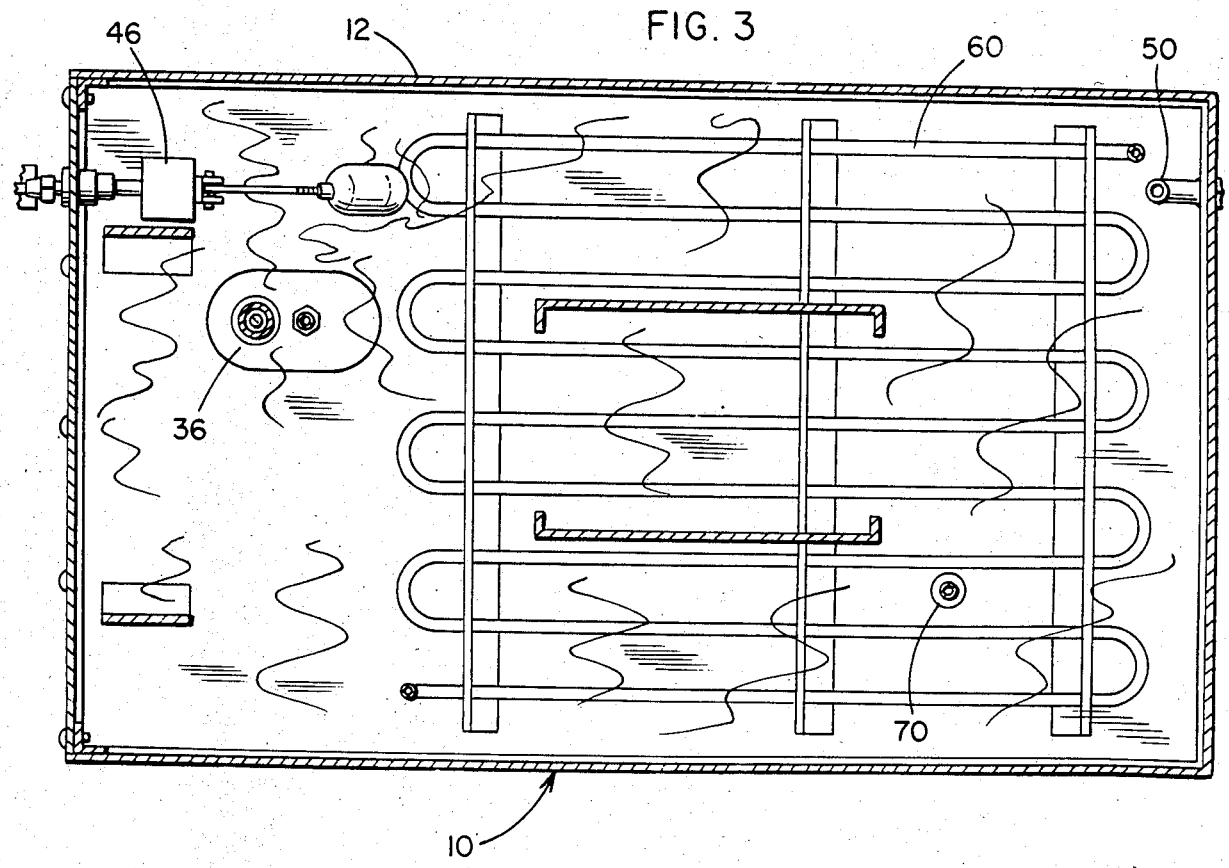
FIG. 3 is a horizontal sectional view taken substantially upon the plane indicated by the section line 3—3 of FIG. 2.

Referring now more specifically to the drawings the numeral 10 generally designates the unitary evaporative cooler assembly of the instant invention incorporating a mechanical refrigeration supplement. The assembly 10 includes a hollow housing 12 defining an air inlet 14 and an air outlet 16. A duct assembly 18 includes an inlet end portion 20 into which the outlet 16 opens and an outlet end 22 which may open into the interior of an attendant building (not shown) to which cooled air is to be supplied. The assembly 10 is mounted upon a pad 24 which may be mounted upon the roof of the aforementioned building or otherwise positioned, as desired.

The inlet 14 may open outwardly to the ambient air, or may have the outlet end of a second duct assembly (not shown) operatively associated therewith and the inlet end of such a second duct assembly may receive air from the interior of the aforementioned building.

The assembly 10 is conventional in that it includes an evaporative pad 26 extending across the inlet 14 and to the upper portion of which pad 26 water 28 is supplied at a controlled rate from a water sump 30 within the housing 12. A squirrel cage blower assembly referred to in general by the reference numeral is mounted within the housing 12 for drawing air inward through the inlet 14 and through the pad 26 and discharging air outward through the outlet 16, the blower assembly 32 being driven by an electric motor 34 through the utilization of suitable conventional controls (not shown).

The interior of the housing 12 also includes a conventional motor driven pump 36 for pumping water from the sump 30 into a manifold 38 extending across the top of the pad 26 and including a plurality of outlets 40 for discharging water down onto the top of the vertically disposed pad 26. As water is discharged from the outlets 40 onto the pad 26, the water flows downwardly through the pad 26 and any excess water falls from the bottom of the pad down into the sump 30 as at 42.

Figure 2:
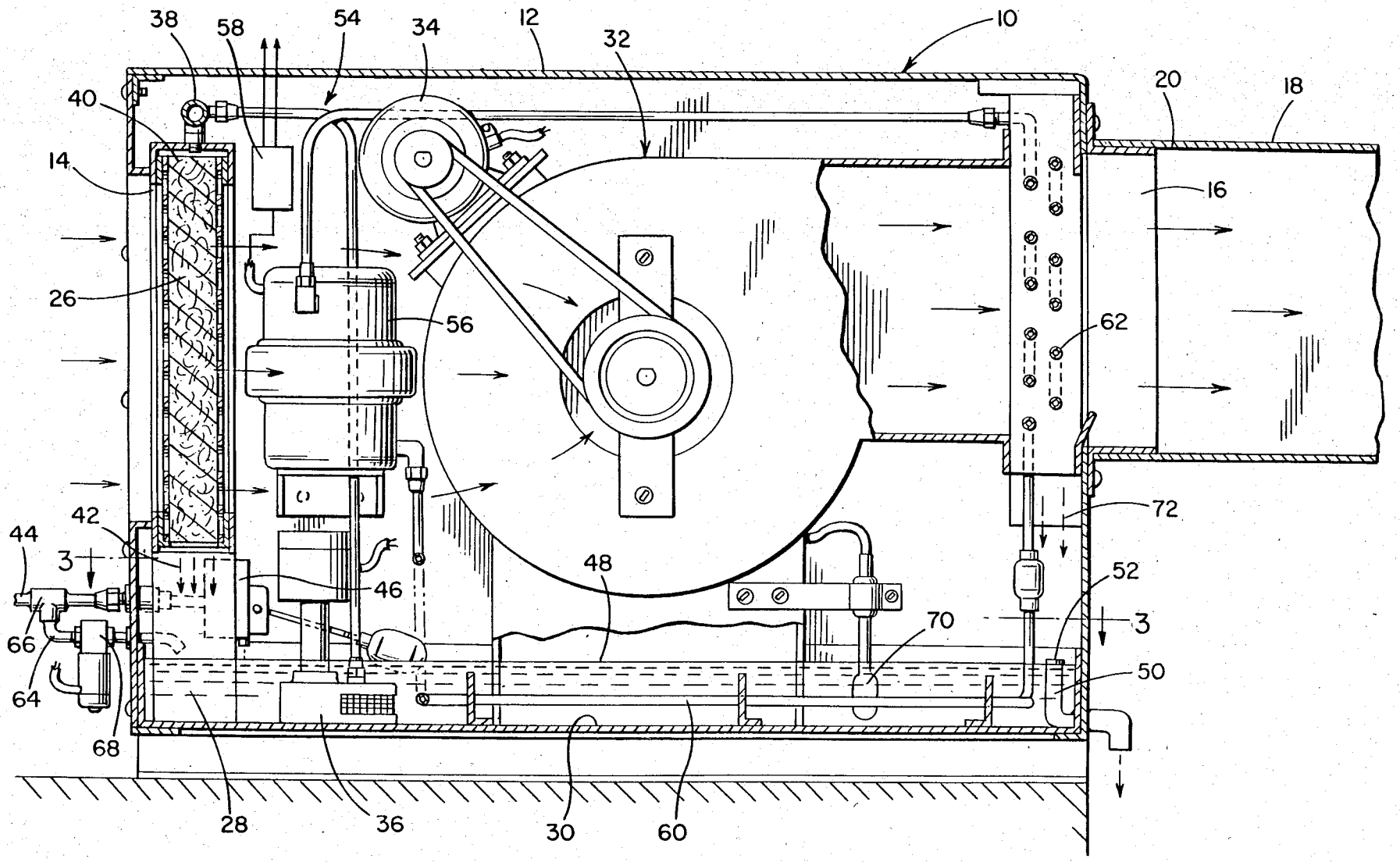
FIG. 2 is an enlarged vertical sectional view taken substantially upon the plane indicated by the section line 2—2 of FIG. 1.

Water is supplied to the sump 30 through a domestic water supply line 44 under the control of a float controlled valve assembly 46. The valve assembly is operative to maintain the level of water 28 in the sump 30 to the level 48 shown in FIG. 2, the sump 30 including an overflow drain outlet 50 for draining excess water 28 from the sump 30 when the water level reaches the top 52 of the outlet 50. Of course, the motor 34 and pump 36 are under control of conventional cooler controls (not shown).

The foregoing comprises a description of a convention form of evaporative cooler assembly.

The refrigeration supplement of the instant invention is referred to in general by the reference numeral 54 and includes a motor driven compresser 56 of conventional design and under the control of a thermostat control 58 within the housing 12 downstream of the evaporative pad 26 and upstream from the outlet 16. The supplement 54 includes a condenser coil 60 disposed within the sump 30 below the level 48 and an evaporative coil 62 extending across the outlet 16. In addition, the supplement 54 further includes a bypass water supply line 64 opening outward from the supply line 44 through a tee 66 and having a solenoid actuated control valve 68 serially connected therein under the control of a temperature sensor 70 disposed within the sump 30 below the level 48.

The evaporator coil 62 is operative to gravity flow moisture condensing thereon downward from the lower end of the coil 62 as at 72 into the sump 30.

In operation, the cooler assembly 10 is operative in the conventional manner to cool air flowing therethrough by passage of the air flow through the damp evaporator pad 26. However, when the termostat 58 senses that the air being discharged from the evaporator pad 26 is above a predetermined maximum, the compressor 56 is actuated and the air being discharged through the outlet 16 is further cooled by the evaporator coil 62. The condenser coil 60, during operation of the compresser 56, becomes heated and heat is transferred to the water 28 within the sump 30. However, extended periods of operation of the compresser 56 ultimately will cause the water 28 within the sump 30 to be heated above a predetermined maximum temperature. At this point the temperature sensor 70 will actuate the solenoid valve 68 in the bypass water supply line 64 in order to allow fresh cool water to be admitted into the sump 30. Of course, as excess cool water is admitted into the sump 30, the excess water within the sump 30 will drain therefrom through the drain line 50. However, inasmuch as the source of water is at a temperature between 50 and 60 degrees Fahrenheit, the entrance of additional cool water into the sump 30 will be sufficient to lower the temperature of the water within the sump sufficient to cool the condenser coil 60 the desired amount in order to prevent head pressure in the compresser 56 from being raised excessively. As soon as the temperature of the water 28 in the sump 30 is sufficiently reduced, the temperature sensor 70 will deactuate the solenoid operated valve in order to close the same.

Thus, a conventional air cooling assembly of the evaporative type is provided and may be used in the normal manner. However, when the humidity and temperature increase above normal humidity and temperature levels, the supplement 54 automatically will be actuated in order to further cool the air being discharged from the outlet 16. In addition, all of the major components of the supplement 54 are received within the same housing used to house the conventional evaporative cooler assembly.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A unitary evaporative cooler assembly with mechanical refrigeration supplement, said assembly including a hollow housing having an air inlet and an air outlet, blower means in said housing operative to draw air into said housing through said inlet and to pump air from within said housing outward through said outlet, evaporative cooler pad means operatively associated with said inlet for cooling the air entering said housing by evaporation of water from said pad, a water sump in said housing for containing water to a predetermined first level, water pump means in said housing for pumping water from said sump to said evaporative pad, controlled water supply means for supplying water to said sump and including water level control means for initiating operation of said water supply means upon the level of water in said sump being lowered to a second level below said first level and terminating operation of said water supply means responsive to the level of water in said sump reaching a third level between said first and second levels, overflow drain means for said sump means operative to drain water therefrom in excess of first level, said water supply means including a thermostat controlled water supply bypass means for bypassing said water level control means and supplying water to said sump responsive to a rise in temperature in said sump above a predetermined temperature, mechanical refrigeration means mounted from said housing and including a condenser coil disposed in said sump below said second level and an evaporator coil disposed in the flow of air passing through said housing downstream from said cooler pad means and being discharged from said air outlet, and temperature responsive control means for initiating operation of said mechanical refrigeration means responsive to the temperature of said air flow intermediate said evaporative pad and evaporator coil increasing above a predetermined air temperature.

2. The cooler assembly of claim 1 wherein said evaporator coil is positioned for gravity flow of water condensing thereon down into said sump.

3. The cooler assembly of claim 1 wherein said mechanical refrigeration means includes a motor driven compressor mounted within said housing.

4. The cooler assembly of claim 3 wherein said evaporator coil also is disposed within said housing.

5. A unitary evaporative cooler assembly with refrigeration supplement, said assembly including a hollow housing defining an air flow path therethrough including an inlet and an outlet, blower means operative to effect air movement through said housing along said air flow path, evaporative cooler pad means operatively associated with said air flow path adjacent said inlet for cooling air moving along said path by evaporation of water from said pad, a water sump in said housing for containing water to a predetermined first level, water pump means in said housing for pumping water from said sump to said cooler pad means, water level controlled water supply means for supplying water to said sump to a second level below said first level, overflow drain means for said sump operative to drain water therefrom in excess of said first level, temperature responsive water supply means for supplying cool ground-temperature water to said sump responsive to the temperature of water in said sump being raised above a predetermined temperature, mechanical refrigeration means including an evaporator coil disposed in said air flow downstream from said cooler pad means and a condenser coil disposed in said sump below said second level, and temperature responsive control means for initiating operation of said mechanical refrigeration means responsive to temperature of said air flow intermediate said evaporative pad and evaporator coil increasing above a predetermined temperature.

6. The assembly of claim 5 wherein said mechanical refrigeration means includes a motor driven compressor mounted within said housing.

7. The assembly of claim 5 wherein said evaporator coil also is disposed within said housing.

* * * * *